US012338612B2

(12) United States Patent
Ko et al.

(10) Patent No.: US 12,338,612 B2
(45) Date of Patent: Jun. 24, 2025

(54) STRUCTURE FOR WATER DRAINAGE HEAD

(71) Applicants: CHUNG CHENG FAUCET CO., LTD., Taichung (TW); Jui-Feng Ko, Taichung (TW); Jian-Hong Ko, Taichung (TW)

(72) Inventors: Jui-Feng Ko, Taichung (TW); Jian-Hong Ko, Taichung (TW)

(73) Assignees: Jui-Feng Ko, Taichung (TW); Jian-Hong Ko, Taichung (TW); CHUNG CHENG FAUCET CO., LTD., Taichung (TW)

( * ) Notice: Subject to any disclaimer, the term of this patent is extended or adjusted under 35 U.S.C. 154(b) by 292 days.

(21) Appl. No.: 17/930,974

(22) Filed: Sep. 9, 2022

(65) Prior Publication Data

US 2023/0084506 A1 Mar. 16, 2023

(51) Int. Cl.
*E03C 1/23* (2006.01)

(52) U.S. Cl.
CPC ..... *E03C 1/2302* (2013.01)

(58) Field of Classification Search
CPC ..... E03C 1/2302; E03C 1/2306
USPC ..... 4/689, 287, 682, 684
See application file for complete search history.

(56) References Cited

U.S. PATENT DOCUMENTS 5,925,242 A * 7/1999 McGhee ..... E03F 5/0408 4/689
6,067,669 A * 5/2000 Peterson ..... E03C 1/262 4/291
6,195,819 B1 * 3/2001 Wang ..... E03C 1/23 4/689
8,701,224 B2 * 4/2014 Li ..... E03C 1/2306 4/689
11,066,820 B1 * 7/2021 Yang ..... E03C 1/2306
2012/0060275 A1 * 3/2012 Cheng ..... E03C 1/2306 4/689
2019/0055722 A1 * 2/2019 Zhang ..... E03C 1/2302

FOREIGN PATENT DOCUMENTS

KR 200368843 Y1 * 12/2004
TW I729824 B * 6/2021 ..... E03C 1/23

OTHER PUBLICATIONS

KR200368843 Machine Translation (Year: 2024).*
TWI729824 Machine Translation (Year: 2024).*

* cited by examiner

*Primary Examiner* — Erin Deery
*Assistant Examiner* — William R Klotz
(74) *Attorney, Agent, or Firm* — Birchwood IP

(57) ABSTRACT

A drainage switch that can be used to extract and clean impurities is provided, which is mainly equipped with a set of elastic water stop plugs. The elastic water stop plug is composed of a main body around with elastic blocks, a pressure positioning piece, a lifting piece, and springs that are arranged inside the shaft tube of the main body, and a plug cap that is locked in the pressure positioning piece. The elastic blocks can be elastically against with a water pipe, so that the elastic water stop plug can be elastically clamped in a water pipe, which is easy to install and replace, and easy to take out and clean dirt.

3 Claims, 7 Drawing Sheets

STRUCTURE FOR WATER DRAINAGE HEAD

CROSS-REFERENCE TO RELATED APPLICATIONS

This application claims the benefit and priority of Taiwan Patent Application Number 110210682, filed on Sep. 9, 2021, the disclosures of which are incorporated herein by reference in their entireties.

TECHNICAL FIELD

The present disclosure relates to a drain switch, particularly to a drain switch that can be easily installed and elastically pressed with an elastic water stop plug to extract and clean impurities.

BACKGROUND

In general, in order to meet the needs of drainage and water storage, a water stop plug is usually set on the bottom of the washstand. The water stop plug can play an opening or closing function through different action operations. If water storage is needed, the water stop plug will be used to seal the washstand, so that water will not flow into the drainage pipe; if drainage is required, the water stop plug is opened, and water will flow out of the drainage pipe. The switching function is performed through the water stop plug.

In order to have switching function, common water stop plugs is usually fixed in the drainage pipe, and is carried out by changing the relative position, such as spring pressing or lever switching. After being used for a long time, some scale, dirt, hair and other impurities will stay around the water stop plug, which will not only make the drainage pipe dirty, but also affect the smooth flow of water. However, the water stop plug cannot be taken out and cleaned directly, causing considerable inconvenience in use due to functional failure.

SUMMARY

The disclosure provides an improved drainage switch structure, which includes a water pipe, wherein a central part of the water pipe is provided with a through hole; an elastic water stop plug, which is arranged in the through hole of the water pipe, includes a main body and a plug cap which is pressure controlled to rise and fall; an elastic block is provided around an outer side of the main body; the elastic block includes a base, wherein the base is protruding provided on the outer side of the main body; a plurality of elastic sheets are upward provided on an outer side of the base; the plurality of the elastic sheets are capable of elastically clamping against an inner wall of the through hole to form an elastic positioning.

The disclosure provides an improved drainage switch structure. The elastic block on the out side of the main body can have an elastic clamping effect on the water pipe through these elastic sheets, so that it can be elastically clamped in the water pipe, and can be easily taken out for cleaning. In addition, these elastic sheets are set upward, which can help prevent some dirt and keep the bottom of the water pipe clean.

DETAILED DESCRIPTION OF THE EMBODIMENTS

Figure 1:
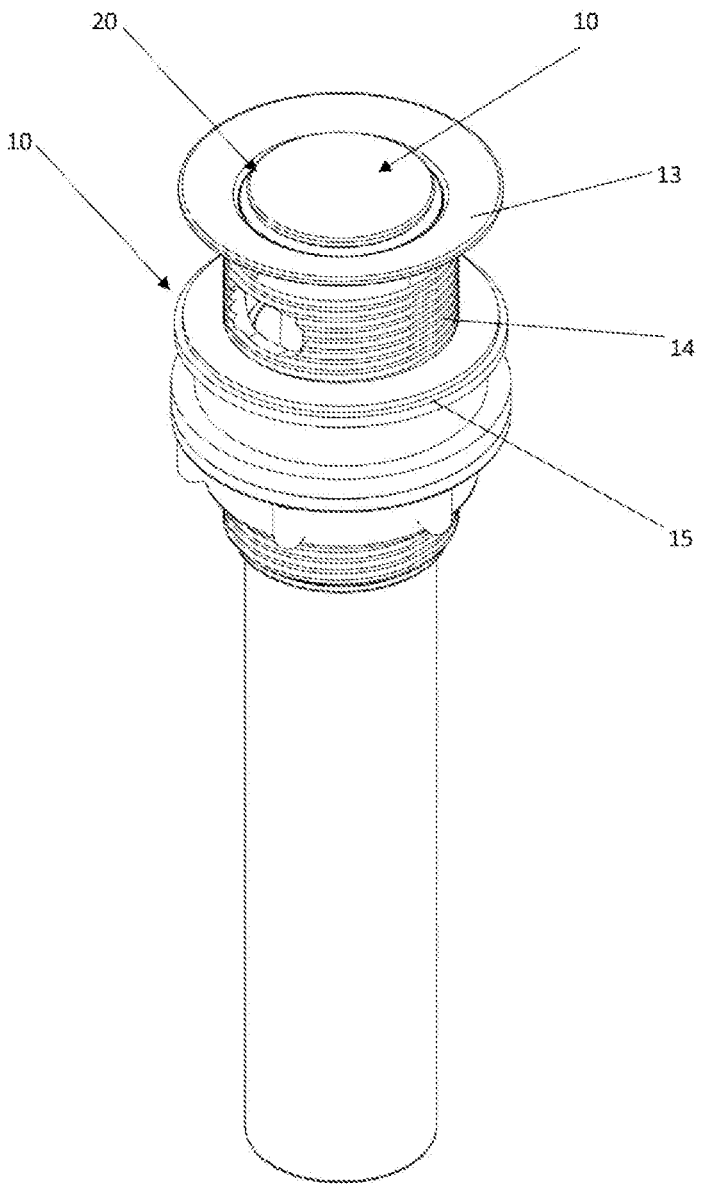
FIG. 1 is a perspective view showing of the appearance of a preferred embodiment of this disclosure.
Figure 2:
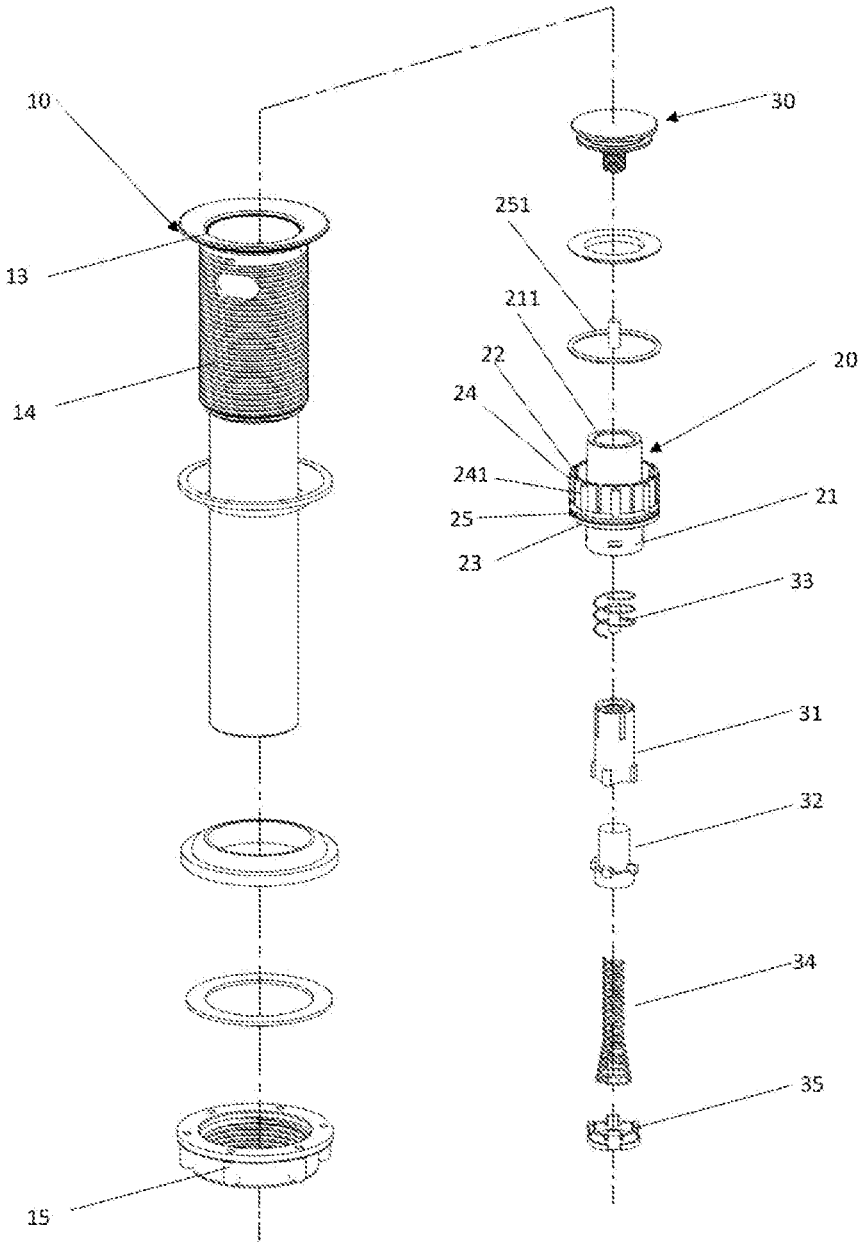
FIG. 2 is a perspective exploded view of the preferred embodiment of the disclosure.
Figure 3:
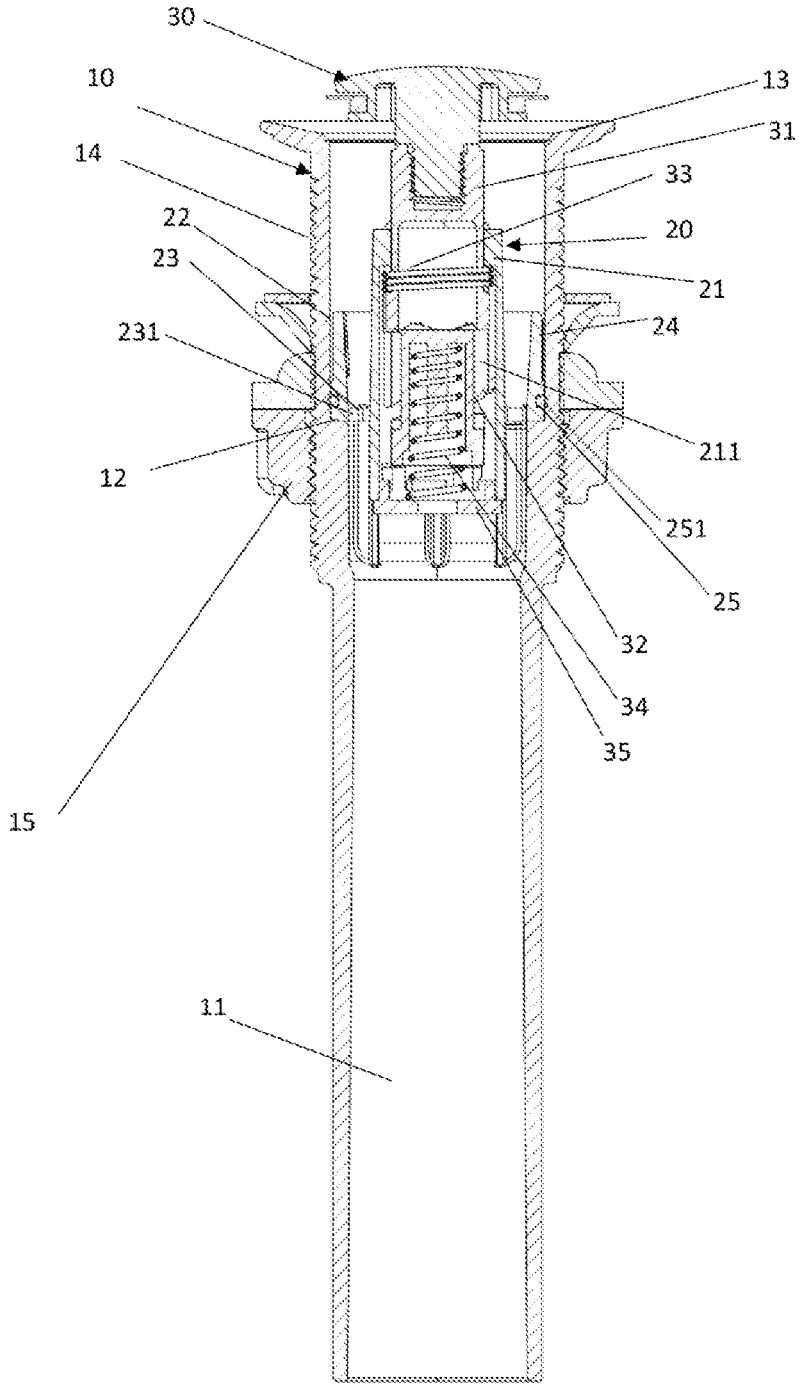
FIG. 3 is a sectional view of the preferred embodiment of the disclosure in the open state.
Figure 4:
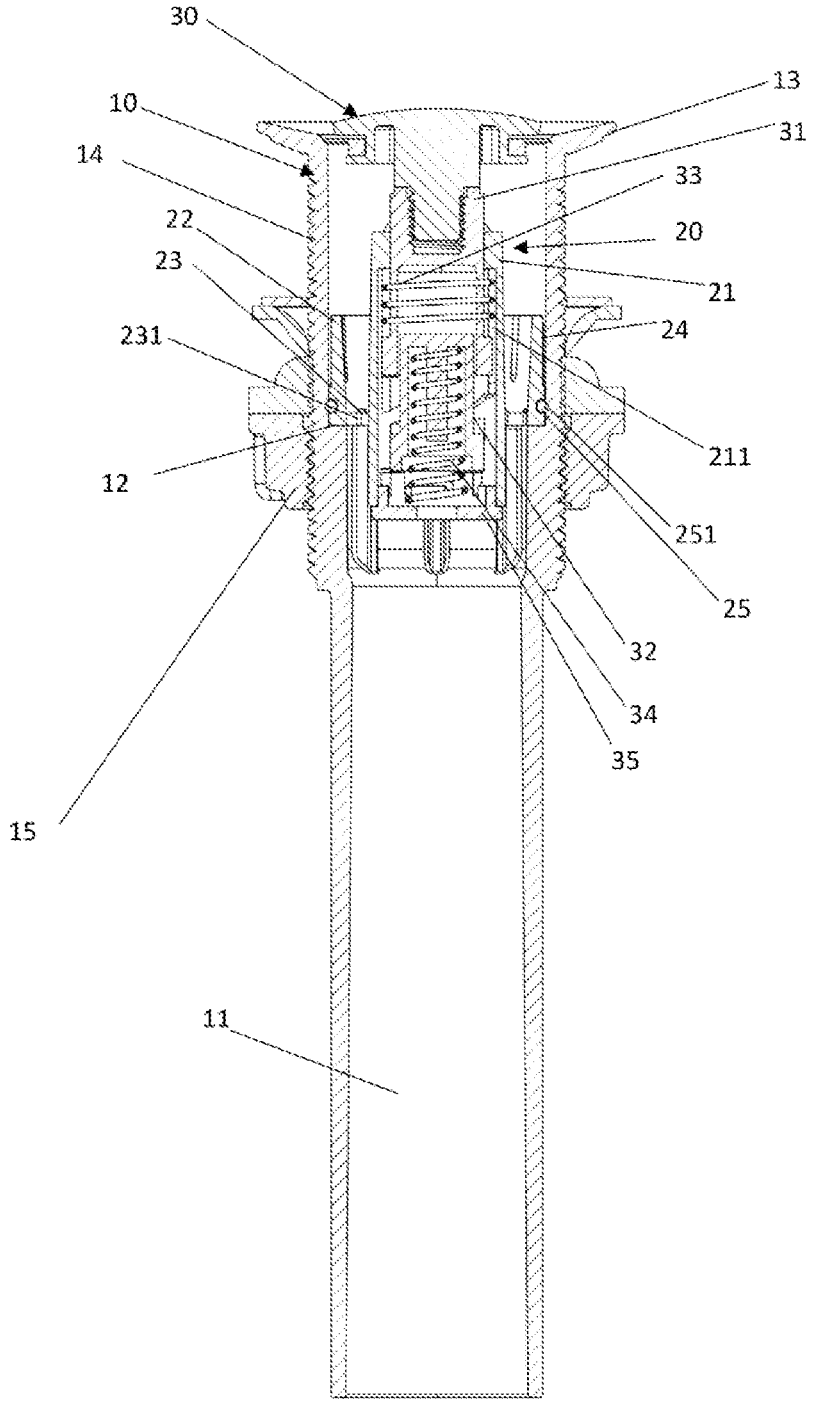
FIG. 4 is a sectional view of the preferred embodiment of the disclosure in the closed state.
Figure 5:
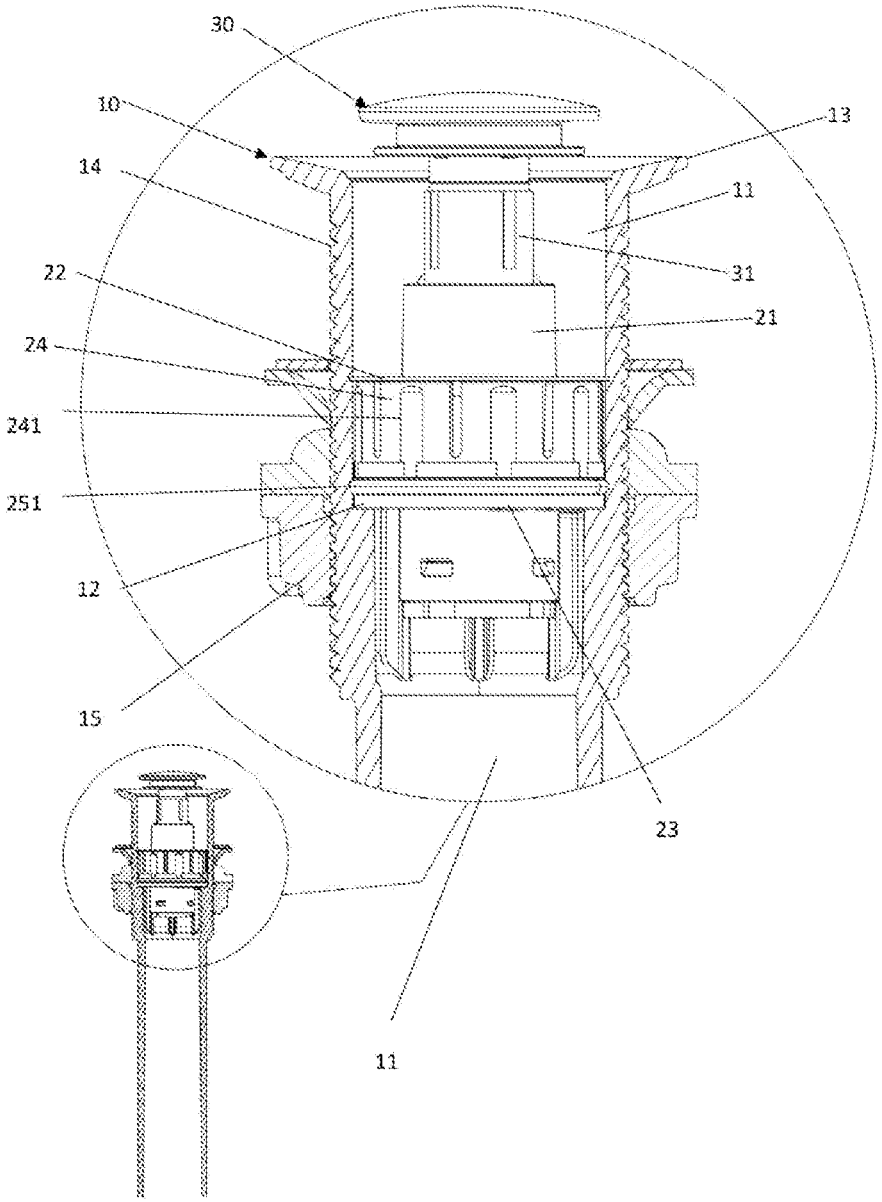
FIG. 5 is an enlarged view of the local section of the water pipe in the preferred embodiment of this disclosure.
Figure 6:
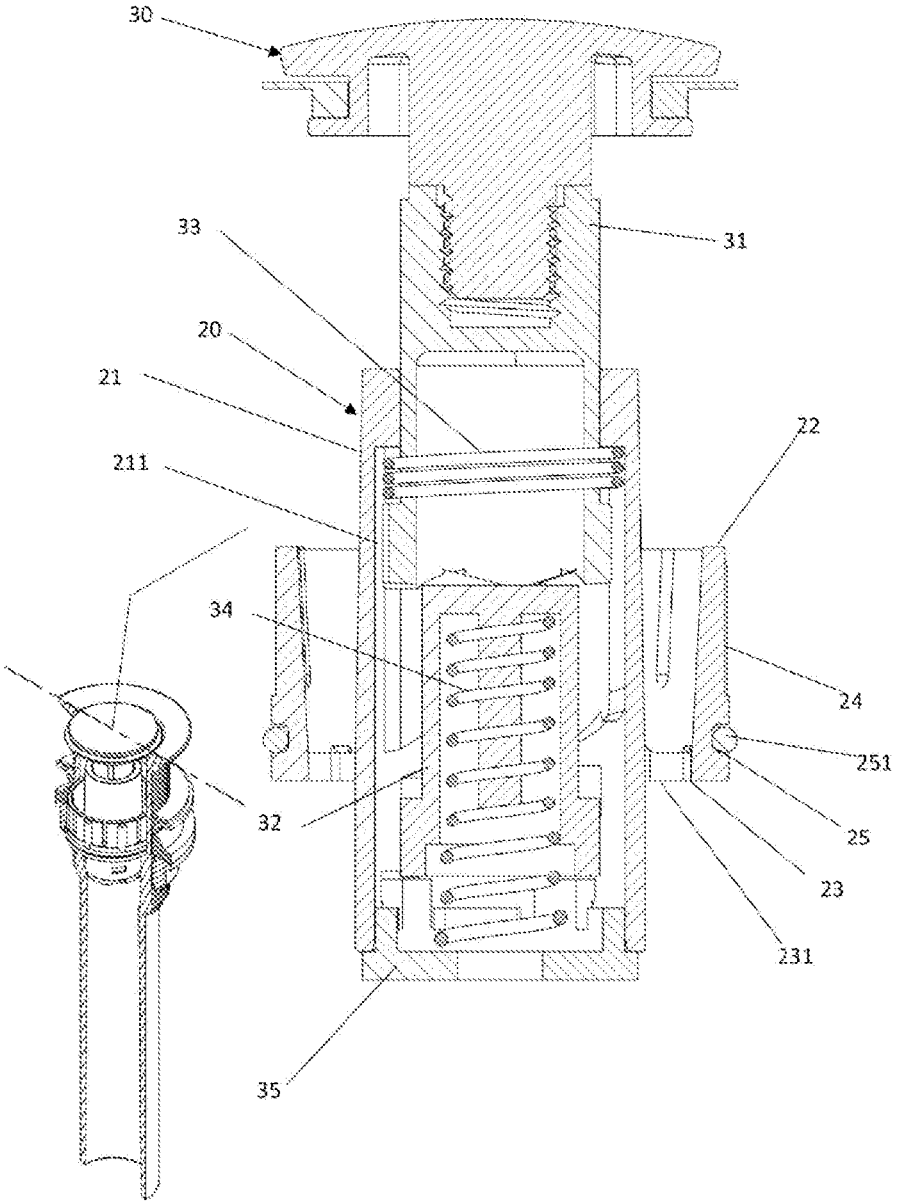
FIG. 6 is a sectional view of the elastic water stop plug in this disclosure.
Figure 7:
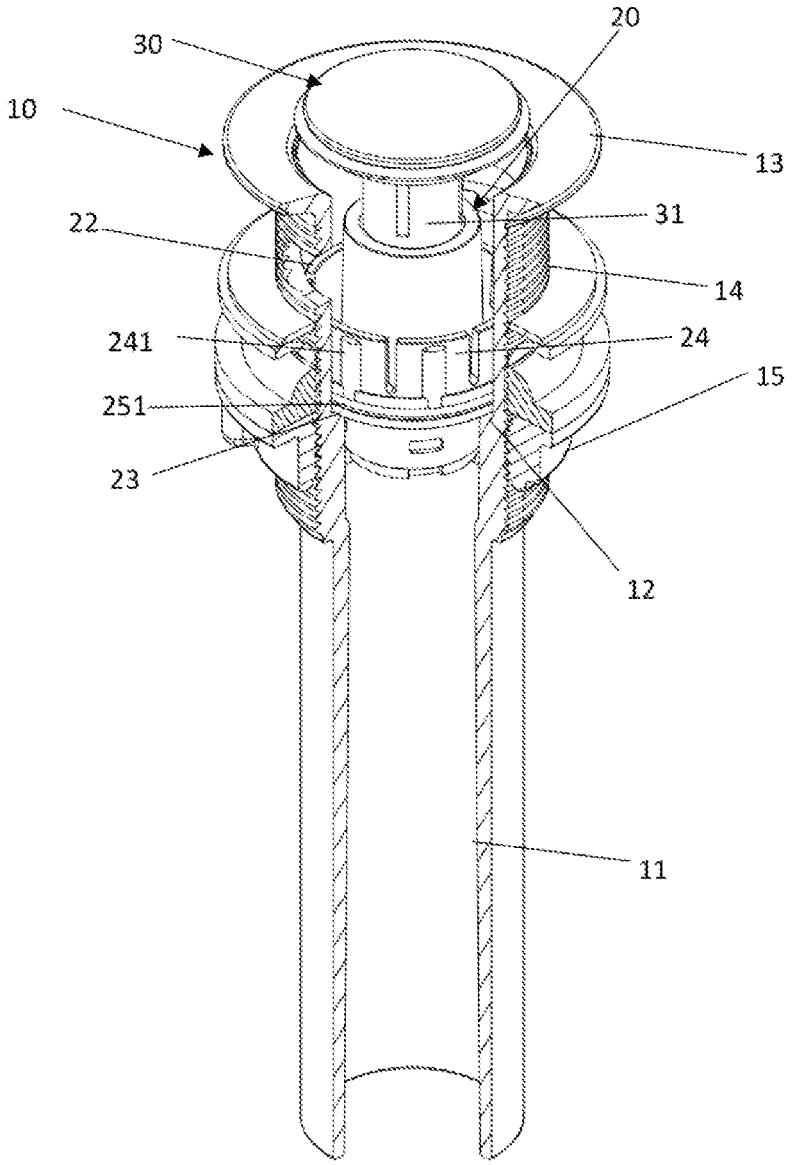
FIG. 7 is a perspective view showing of the appearance of the water pipe section of this disclosure.

Please refer to FIG. 1 to FIG. 7, which relates to a preferred embodiment of the drain switch in this disclosure, and the disclosure comprises the following elements:

A water pipe 10, which is arranged at the bottom of the washstand or bathtub, has a through hole 11 hollowed in the center. A step surface 12 is provided at a predetermined position of the through hole 11. In order to combine with the washstand, the outside of the water pipe 10 will be provided with a limit surface 13 and an external thread 14 on the top surface. The external thread 14 is arranged below the limit surface 13. The external thread 14 is provided with an positioning nut 15 to adjust the position. The positioning nut 15 is threaded on the external thread 14, so that the stop surface 13 and the positioning nut 15 can position the water pipe 10 at the bottom of the washstand, and the water pipe 10 can also be fixed in other ways without limitation.

An elastic water stop plug 20, which is contained in the through hole 11 of the water pipe 10, has a main body 21 and a plug cap 30 that can be pressure controlled to rise and fall. The outer side of the main body 21 is provided around an elastic block 22. The elastic block 22 includes a base 23, wherein the base is protruding arranged on the outside of the base 21 and can be limited by the step surface 12 to fix its position. The base 23 is also provided with several channels 231, and the channels 231 can keep the through hole 11 of the water pipe connected. A plurality of elastic sheets 24 projected upward and the ring groove 25 are provided on the outside of the base 23. The elastic sheets 24 are projected outward, that is, a protrusion part 241 is provided at the surface toward the water pipe 10, so that the elastic sheet 24 can be elastically clamped to the inner wall of the through hole 11 through the protrusion part 241 to form an elastic positioning, and the elastic sheet 24 can maintain a gap with the through hole 11. In addition, an O-ring 251 is sleeved on the ring groove 25. The plug cap 30 is arranged in the main body 21, and an shaft tube 211 is arranged in the main body 21. The plug cap 30 is arranged in the shaft tube 211 with an elastic pressing component composed of a pressure positioning piece 31, a lifting piece 32, a first spring 33 and a second spring 34, and is sealed and limited by a cover 35. The plug cap 30 is arranged at the top of the pressure positioning piece 31. When the plug cap 30 is assembled in the water pipe 10, by using of the assembly relationship of the pressure positioning piece 31, the lifting piece 32, the first spring 33 and the second spring 34 which are arranged in the plug cap 30 allows it to change the relative relationship between the pressure positioning piece 31 and the lifting piece 32 by pressing the plug cap 30, such that the plug cap 30 can be pressed downward to seal the water pipe 10 or be lifted away from the water pipe 10, so as to achieve the switching function between sealing and normal drainage.

As shown in FIG. 1 to FIG. 7, in daily use, water can flow into the through hole 11 and through the periphery of the main body 21. For example, at the channel 231 of the base 23, there will be a gap between the elastic sheets 24 and the through hole 11. If hair or debris and other objects fall in, the elastic sheets 24 will also produce a blocking effect to prevent further downward flow to block the lower part. After a long time of use, when the water flow is not discharged smoothly, it can be known that the inside of the water pipe 10 may have been blocked and needs to be cleaned. At this time, just apply an upward force to the whole set of elastic water stop plug 20, so that the elastic block 22 is not longer limited in the elastic clamp in the through hole 11, but can be taken out for cleaning, and then the elastic block 22 can be put back in after cleaning.

To sum up, it should be known that the present disclosure is of industrial utilization, advancement and practicality, and the present disclosure has not been published in any publication, which is also novel. The present disclosure complies with the Patent Law, such that applicant hereby files a new patent application in accordance with the law, and requests examiner to grant the patent.

The above description is only a feasible embodiment of the present disclosure, which should not be used to limit the scope of the present disclosure. All equal changes and modifications made in accordance with the scope of the present disclosure shall be within the scope of the present disclosure.

BRIEF DESCRIPTION OF MARKS IN DRAWINGS

10—Water pipe; 11—through hole; 12—Step surface;
13—Limit surface; 14—External thread; 15—Positioning nut;
20—Elastic water stop plug; 21—Main body; 211—Shaft tube;
22—elastic block; 23—Base; 231—Channel;
24—Elastic sheet; 241—protrusion part; 25—Ring groove;
251—O-ring;
30—Plug cap; 31—pressure positioning piece; 32—lifting piece;
33—The first Spring; 34—The second spring; 35—Cover.

What is claimed is:

1. An improved drainage switch structure, comprising:

a water pipe, wherein a central part of the water pipe is provided with a through hole;

an elastic water stop plug, which is arranged in the through hole of the water pipe, comprises a main body and a plug cap which is pressure controlled to rise and fall; an elastic block is provided around an outer side of the main body; the elastic block comprises a base, wherein the base is protruding provided on the outer side of the main body; a plurality of elastic sheets are upward provided on an outer side of the base; the plurality of the elastic sheets are capable of elastically abutting against an inner wall of the through hole to form an elastic positioning;

wherein an outer side of each of the plurality of the elastic sheets of the elastic block is provided with a protrusion part, so that there is a gap between each of the plurality of the elastic sheets and the water pipe;

the base is provided with a ring groove, and the ring groove is provided with an O-ring; and a top surface of the water pipe is provided with a limit surface, an outer circumference below the limit surface is provided with an external thread, and a positioning nut is thread on the external thread.

2. The improved drainage switch structure according to claim 1, wherein a step surface is protruding provided inside the through hole of the water pipe, and the base of the elastic water stop plug is limited on the step surface.

3. The improved drainage switch structure according to claim 1, wherein a plurality of channels are provided on the base.

* * * * *